US005332090A

United States Patent [19]

Tucker

[11] Patent Number: 5,332,090

[45] Date of Patent: Jul. 26, 1994

[54] GOLF PUTTER HOLDER

[75] Inventor: Richard B. C. Tucker, Baltimore, Md.

[73] Assignee: Wm. T. Burnett & Co., Inc., Baltimore, Md.

[21] Appl. No.: 5,890

[22] Filed: Jan. 22, 1987

[51] Int. Cl.[5] ..... A63B 55/00

[52] U.S. Cl. ..... 206/315.3; 248/314

[58] Field of Search ..... 248/312.1, 312, 314, 248/316.7; 206/315.3

[56] References Cited

U.S. PATENT DOCUMENTS

| | | | |
|---|---|---|---|
| 1,236,929 | 8/1917 | Hauck | 248/312 |
| 1,897,248 | 2/1933 | Ferguson | 248/312 |
| 2,713,469 | 7/1955 | Wright | 248/316.7 |
| 3,452,955 | 7/1969 | Hartwig | 248/316.7 |
| 3,653,624 | 4/1972 | Abel | 248/312 |
| 4,100,652 | 7/1978 | Carlson | 206/315.3 |
| 4,219,178 | 8/1980 | Assion | 248/314 |
| 4,449,310 | 5/1984 | Kune | 206/315.3 |

*Primary Examiner*—Joseph M. Moy

*Attorney, Agent, or Firm*—Breiner & Breiner

[57] ABSTRACT

A lightweight molded golf putter holder for attachment to a golf bag is described. The holder has a generally U-shaped clip portion and a tubular body portion integral with the clip portion. The tubular body portion has a side opening which permits the insertion of a tapered putter shaft at the smaller diameter of the shaft but not at the larger diameter end of the shaft. In this way when the putter shaft is inserted into the holder, it cannot be removed until the putter is again lifted from the holder.

5 Claims, 1 Drawing Sheet

GOLF PUTTER HOLDER

FIELD OF INVENTION

This invention relates to a golf putter holder. More particularly the invention relates to a golf bag having in combination therewith a holder for attachment to a golf bag to separately hold a golf putter.

BACKGROUND OF INVENTION

In playing the game of golf it is necessary that the player have all of his clubs at hand for convenient use. Conventionally this is accomplished by carrying the clubs, shaft down, in a golf bag which is carried by the golfer over his shoulder, on a cart which is hand-pulled, or on a mechanized cart. Regardless of how carried, the one club most frequently used and used on practically every hole, the putter, is the one most difficult to locate within the bag since it is the shortest club and, accordingly, the club which rests lowermost in the bag, nestled among the other clubs..

To improve the accessibility of clubs and to overcome the frustration of locating clubs within a golf bag, golf bags have been suggested having dividers or holders for the individual clubs. Note U.S. Pat. Nos. 1,597,870; 1,599,170; 2,128,546; 2,143,644; 2,521,573; 2,595,987; 3,503,518; 4,181,167, and 4,304,278. Additionally, U.S. Pat. No. 4,100,652 discloses an anchor clip for detachably mounting to the rim of a golf club bag for holding an individual club. In all instances the clubs individually held are positioned within the golf bag with the shaft downward. Accordingly, an individual club particularly the putter is still not as readily accessible as one would like. Although U.S. Pat. No. 2,621,799 discloses U-shaped collars for attachment to a golf bag for retaining golf clubs on the outside of the bag, this collar is relatively complex and can be effectively used only in combination with a bag carried on a hand-pulled golf cart in that the clubs when positioned in the holder extend beyond the bottom of the bag and, thus, would interfere with the use of other types of bags and carts.

OBJECTS AND GENERAL DESCRIPTION OF THE INVENTION

Accordingly, it is a primary object of the present invention to provide a holder for attachment to the rim of a golf bag for separately retaining a golf putter to make it readily obtainable.

It is another primary object of the invention to provide a holder for attachment to the rim of a golf bag for separately retaining a golf putter on the outside of the golf bag, with the putter shaft being upward.

It is another object of the invention to provide, in combination, a golf bag and a holder attached to the rim of the golf bag which is constructed and arranged to receive the shaft of the putter with the putter head down, and to retain the putter throughout its length closely adjacent to the bag.

These and other objects of the invention will be apparent from the following description, with particular emphasis being directed to the drawing.

The objects of the present invention are accomplished by providing a holder, molded from plastic, having a substantially U-shaped clip portion for attachment to the rim of a golf bag, and a body portion integral with the clip portion having a tubular shape open at one side for receiving and retaining a golf putter having a tapered shaft at the grip end of the shaft. The open side is designed to be of a size sufficiently large to receive the putter shaft at or in the vicinity of the head only, and also sufficiently small to prevent removal of the shaft through the opening at the grip end of the shaft. In this way the putter is retained closely aligned with the body of the bag throughout its entire length, with the putter being readily grasped by the player at the shaft end. The shaft is raised within the holder and removed at or near the head end of the shaft. Accordingly, the player is secure in knowing that the putter will not be lost as a result of its slipping from the holder.

The golf putter holder of the present invention is of simple construction and can be positioned and repositioned anywhere around the top of the bag to any preferred position. When the holder and the putter are positioned on the outside of the bag, it is not necessary to search for the putter within the bag, thus preventing injury to the fingers of a player while attempting to locate the putter within the bag. Additionally, wear and tear on the handgrip of the putter is eliminated in that the putter is not constantly rubbing against the other clubs in the bag. Also, damage to expensive woods as a result of banging against the putter's metal head and shaft, as well as scratches on metal clubs as a result of constantly putting the putter into and taking the putter out of the bag, is eliminated.

THE DRAWING AND PREFERRED EMBODIMENT

A preferred embodiment of the invention will be described in reference to the drawing wherein FIG. 1 is an elevational view of the golf club holder of the present invention in combination with a golf bag and putter;

Figure 1:
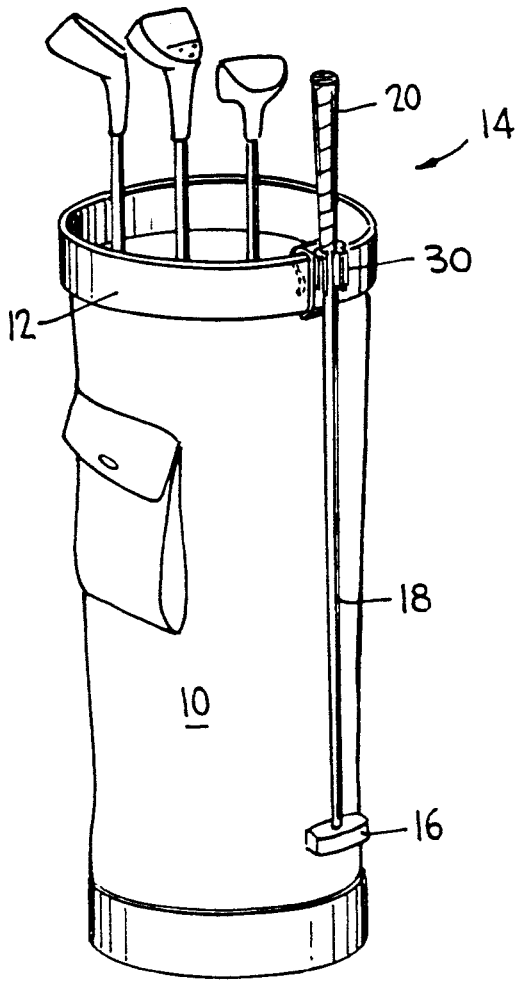
Figure 2:
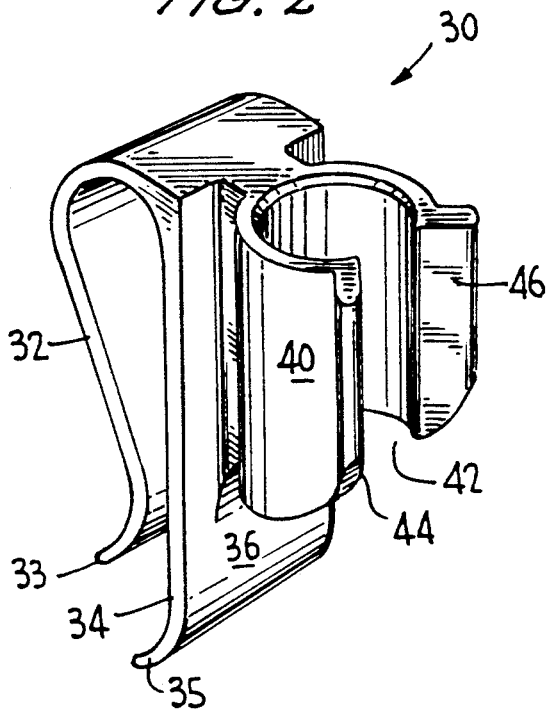
FIG. 2 is a front elevational view of the golf putter holder.
Figure 3:
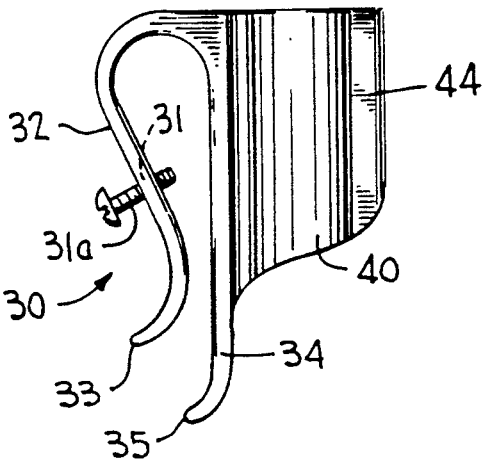
FIG. 3 is a side elevational view of the golf putter holder.
Figure 4:
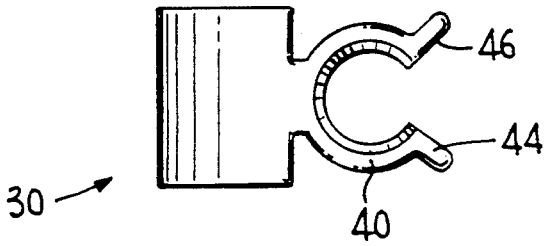
FIG. 4 is a top view of the golf putter holder.

FIG. 1 illustrates the putter holder 30 attached to the rim 12 of golf bag 10, and has retained therein a putter 14. Putter 14 has a head 16 at one end of shaft 18 and a handgrip 20 at the opposite end. The shaft, as is conventional, is tapered with the smaller diameter end being attached to head 16 and the larger diameter end being fitted with a handgrip 20. As best shown in FIGS. 2, 3 and 4, holder 30 is integral and preferably molded from plastic. The holder includes a generally U-shaped clip portion having a curved shorter leg 32 and a longer straight leg 34. At surface 36 of leg 34 which is the surface opposite from curved leg 32 is an elongated body portion 40. Body portion 40 has a generally tubular configuration having an open sidewall 42 opposite of surface 36. Opening 42 is flared, having extensions 44 and 46. Opening 42 is sized to receive shaft 18 of putter 14 at the smaller diameter end, but not at the larger diameter end. As shown in FIGS. 2 and 3, the legs 32 and 34 of the clip portion of the holder have curved ends 33 and 35. Curved end 33 permits easier insertion of the clip onto the rim of the golf bag. Curvature 35 is designed to grip the rim portion of the bag, thereby stabilizing the holder and positioning the putter holder in a vertical plane parallel with the bag. In this way the putter when positioned in the holder does not tilt inward toward the bag.

When the portion of the holder is fixed to the golf bag, putter 14 is inserted into holder 30 through open sidewall 42 at the smaller diameter end of shaft 18 which is toward head 16. The putter is then allowed to slide down into the holder to engage the shaft toward grip end 20. The putter cannot be removed from the holder until it is lifted upward so that the smaller diameter end of the shaft can pass through opening 42. In this way there is no possibility of the putter being accidentally lost from the holder.

As shown only in FIG. 3, in a modified embodiment leg 32 of the clip holder has a threaded hole 31 and a plastic screw 31*a* fitted into the threaded hole. When the clip is attached to the rim of a bag, screw 31*a* can be screwed inward to engage but not screw into the inside rim of the bag to tighten the clip onto the bag rim. In this optional modification the clip can be designed to fit bags having a greater degree of variation in rim thicknesses.

The holder as above noted is molded from plastic. A plastic holder will not rust and, accordingly, cannot impart rust stain to an expensive bag. Further, a molded plastic holder is free from jagged and sharp edges and, accordingly, will not cut and damage a bag or injure the hands of a player. Plastic, being flexible, will permit a holder having a given dimension to fit onto the top rim of a bag having varying thicknesses.

As will be apparent to one skilled in the art, the dimensions of the holder can be varied, which is a design choice. As will be further apparent, various modifications can be made within the scope of the aforesaid description. Additionally, while it is preferred that the holder be used to retain a putter, it can be used to hold another favored club, depending on the preference of the player. Such modifications being within the ability of one skilled in the art form a part of the present invention and are embraced by the appended claims.

It is claimed:

1. A golf putter holder comprising a clip portion for attachment of said holder to a golf bag and a body portion integral with said clip portion for receiving and retaining a golf putter in an upright position, said clip portion comprising a first and second leg with the opening between the legs being constructed and arranged to receive the rim of a golf bag and wherein said first and second legs of said clip portion are of different lengths with each of the legs having a curvature at their extremities, said body portion being integral with said second leg of said clip portion, being elongated and having a generally tubular configuration having an opening at one side and wherein said side opening is flared with extension legs, said opening being sized to permit the free passage of the smaller diameter putter end section of a tapered putter shaft and to retain the larger diameter handle end section of a tapered putter shaft and wherein the diameter of said body portion is greater than that of said smaller diameter section of said tapered putter shaft.

2. A golf putter holder comprising a clip portion for attachment of said holder to a golf bag and a body portion integral with said clip portion for receiving and retaining a golf putter in an upright position, said clip portion comprising a first and second leg with the opening between the legs being constructed and arranged to receive the rim of a golf bag and wherein said first leg has a threaded hole positioned between the closed and open end of the leg and a screw in said hold, said body portion being integral with said second leg of said clip portion, being elongated and having a generally tubular configuration having an opening at one side, said opening being sized to permit the free passage of the smaller diameter putter end section of a tapered putter shaft and to retain the larger diameter handles end section of a tapered putter shaft and wherein the diameter of said body portion is greater than that of said smaller diameter section of said tapered putter shaft.

3. In combination of a golf bag having an annular sidewall, a top opening for receiving golf clubs and a rim surrounding said top opening, and a golf putter holder attached to said rim so that a putter received in said holder will ride along the sidewall of said bag, said putter holder comprising a clip portion for attachment of said holder to said golf bag and a body portion integral with said clip portion for receiving and retaining a golf putter in an upright position, said clip portion comprising a first and second leg with the opening between the legs being constructed and arranged to receive the rim of said golf bag, said body portion being integral with said second leg of said clip portion and being elongated and having a generally tubular configuration having an opening at one side, said opening being sized to permit the free passage of the smaller diameter putter end section of a tapered putter shaft and to retain the larger diameter handle end section of a tapered putter shaft and wherein the diameter of said body portion is greater than that of said smaller diameter section of said tapered putter shaft, and wherein said holder is attached to the rim of said bag in order that said body portion of said holder is on the outside of said bag whereby a putter positioned in the holder will ride along the outside of said bag.

4. In combination a golf bag having a golf putter holder, and a golf putter having a tapered shaft positioned within said holder whereby said putter is lying along the sidewall of said golf bag with the head extending downward, said holder comprising a clip portion for attachment of said holder to said golf bag and a body portion integral with said clip portion for receiving and retaining said golf putter, said clip portion comprising a first and second leg with the opening between the legs being constructed and arranged to receive the rim of said golf bag, said body portion being integral with said second leg of said clip portion and being elongated and having a generally tubular configuration having an opening at one side, said opening being sized to permit passage of the smaller diameter section of said tapered putter shaft and to retain a larger diameter section of said tapered putter shaft.

5. The combination of claim 4 wherein said holder is attached to the rim of said bag in order that said body portion of said holder is on the outside whereby said putter in the holder will ride along the outside of said bag.

* * * * *